United States Patent [19]

Lopez

[11] Patent Number: 4,670,756

[45] Date of Patent: Jun. 2, 1987

[54] PHASE SHIFTER CONTROL

[75] Inventor: Alfred R. Lopez, Commack, N.Y.

[73] Assignee: Hazeltine Corporation, Commack, N.Y.

[21] Appl. No.: 848,533

[22] Filed: Apr. 7, 1986

[51] Int. Cl.[4] ..... H01Q 3/22; H01Q 3/24; H01Q 3/26

[52] U.S. Cl. ..... 342/372; 342/408; 342/35

[58] Field of Search ..... 342/372, 377, 408, 35

[56] References Cited

U.S. PATENT DOCUMENTS 4,166,274 8/1979 Reudink et al. ..... 342/377

4,445,119 4/1984 Works ..... 342/372

*Primary Examiner*—Theodore M. Blum

*Attorney, Agent, or Firm*—E. A. Onders; F. R. Agovino

[57] ABSTRACT

A scanning system for a phased array antenna for operation at a selected frequency between a first frequency and a second frequency includes the storage of phase shift command signals for each of the phase shifters coupled to radiating elements of the antenna. The memory which stores the phase shift commands is addressed sequentially to provide for a step-wise scanning of a beam of radiant energy at a first frequency of the antenna. The addressing is accomplished by incrementing a count resulting from a counting of clock pulses. Compensation for the stepped positions of the beam for the difference between the selected frequency and the first frequency is accomplished by altering the number of pulses which increment the count of the addressing. The altering is accomplished by the storing of sequences of clock pulses at varying temporal spacings which are used for gating out selected ones of the incrementing pulses.

12 Claims, 7 Drawing Figures

PHASE SHIFTER CONTROL

BACKGROUND OF THE INVENTION

This invention relates to phased array antennas and, more particularly, to a system for forming a beam of radiation at various frequencies of radiation.

Arrays of radiating elements are utilized for forming beams of radiant energy for both electromagnetic energy and sonic energy. In the case of sonic energy, the beams are generally formed by transducers of a sonar system, In the case of electromagnetic energy, the radiating elements may take the form of dipoles or other form of radiating elements. In both the cases of electromagnetic and sonic energies, beam-steering units form the beam and direct the beam by the control of delay or phase shift of the radiant energy from one radiating element relative to the radiant energy from a second radiating element of the array. The beam may be made to scan across a region of space, or may be made to jump from region to region as in the case of the tracking of targets located in different directions from the antenna.

While the invention is useful in all of the foregoing situations, it is most readily described for the case of a scanning antenna radiating electromagnetic energy as in the case of a phased-array antenna of a microwave landing system for aircraft at an airport. Therein, a beam scans back and forth to both sides of a runway for use by an incoming aircraft in the generation of guidance signals which guide the aircraft to the runway. Typically, such a beam would be scanned approximately 30° to either side of the runway.

A problem arises in that the beam-steering unit is designed to produce a beam at a specific frequency of electro-magnetic energy. However, in the foregoing in microwave landing system (MLS), it is desirable that the beam-forming be accomplished over a range of frequencies so as to accommodate different signal channels, each characterized by its own frequency, for use by respective ones of the incoming aircraft.

One attempt at solution of the foregoing problem is the utilization of beam-steering units which have been adapted to form beams at each of a number of frequencies. Typically, a beam-steering unit includes a memory for storing data as to the requisite phase shift where phase shifters are utilized, or delay where delay units are utilized, for each radiating element for each direction in which the beam is to be pointed relative to the antenna array. In the case of a scanning antenna, many incremental steps in direction are provided, with each step being less than a beamwidth, so that the beam appears to be smoothly scanned through space even though it is, in fact, being scanned by a rapid succession of steps in direction. The foregoing storage of phase data or delay data would be repeated for a second frequency and for a third frequency, and again for still further frequencies, in the case where the beams are to be formed at different frequencies of radiation. Thereby, the beam-steering unit is able to form and steer the beams at different frequencies of radiation.

The foregoing solution to the problem is disadvantageous in that it requires far more storage than would be required for the single frequency case. The disadvantage is manifested both in terms of system cost and system complexity. In the case of an MLS wherein redundant circuits may be utilized to obtain high reliability, the disadvantage of the utilization of additional memory becomes magnified.

SUMMARY OF THE INVENTION

The foregoing problem is overcome and other advantages are provided by a beam forming system which incorporates the invention to provide for the multiple frequency capability without the need for the additional storage of phase or delay data for each of the frequencies at which the antenna is to radiate. While the invention is equally applicable to systems employing either phase shifters or delay units, the description of the invention is facilitated by considering a specific scanning system utilizing phase shifters.

The theory of the invention can be understood with reference to the formulation of the amount of phase shift required to direct a beam in a specific angle relative to the array. As is well known, the requisite phase shift is proportional to the spacing between two radiating elements, to the frequency, and to the sine of the angle between the beam and a normal to the array. A separate set of data is stored for each angle, and also for each radiating element to accommodate the various distances between one element and its neighbors. It is also noted from the foregoing formulation that a shift in frequency has the same effect as a shift in the sine of the angle.

To compensate for a shift in frequency, the beam-steering unit of the invention commands a value of the sine of an angle other than the one to which the beam is to be pointed. Thereby, the beam actually points in a direction closely approximating the desired angle. The invention is most useful in the situation of the scanning beam wherein the scanning takes place, as noted above, by sequence of stepwise increments of the beam direction. By commanding a value of sine of the angle, somewhat different from the sine of the actual angle desired, a sequence of stepwise increments in the beam direction still results. There may be more or less steps, depending on whether the instant frequency, is greater than or less than the design frequency for which the data is stored in the memory. Thus, the resultant sequence of steps may be more coarse or more fine than the steps of the original sequence. However, as long as the resulting steps are smaller than the beamwidth, an incoming aircraft still responds as though there is a continuously scanned beam.

With respect to the design of the electrical circuitry of the beam forming unit of the invention, it is recognized that for a beam pointing straight ahead of the array, the sine is zero at all frequencies. And for slight deviations in beam direction from the normal to the array, there are relatively small differences in the sine at the various frequencies for which the array is to radiate. Howver, at relatively large angles of deviation of the normal to the array, such as 30°, the resultant differences in phase shift may have passed through many multiples of 360°, depending on the length of the array relative to a wavelength of the radiation. Thus, it is appreciated that in directing the offset commands of the sine, and considering that the multiples of 360° phase shift are to be dropped in the designation of the phase shift of an individual phase shifter, the largest changes in the stepwise increments of beam direction occur for the largest deviations of the beam direction from the normal to the array. As the beam scans past the normal to the array, the changes in the steps become smaller and, accordingly, the beam steering commands essentially "catch up" with the beam-steering commands for radiation at the design frequency.

BRIEF DESCRIPTION OF THE DRAWING

The foregoing aspects and other features of the invention are explained in the following description, taken in connection with the accompanying drawing wherein.

DETAILED DESCRIPTION

Figure 1:
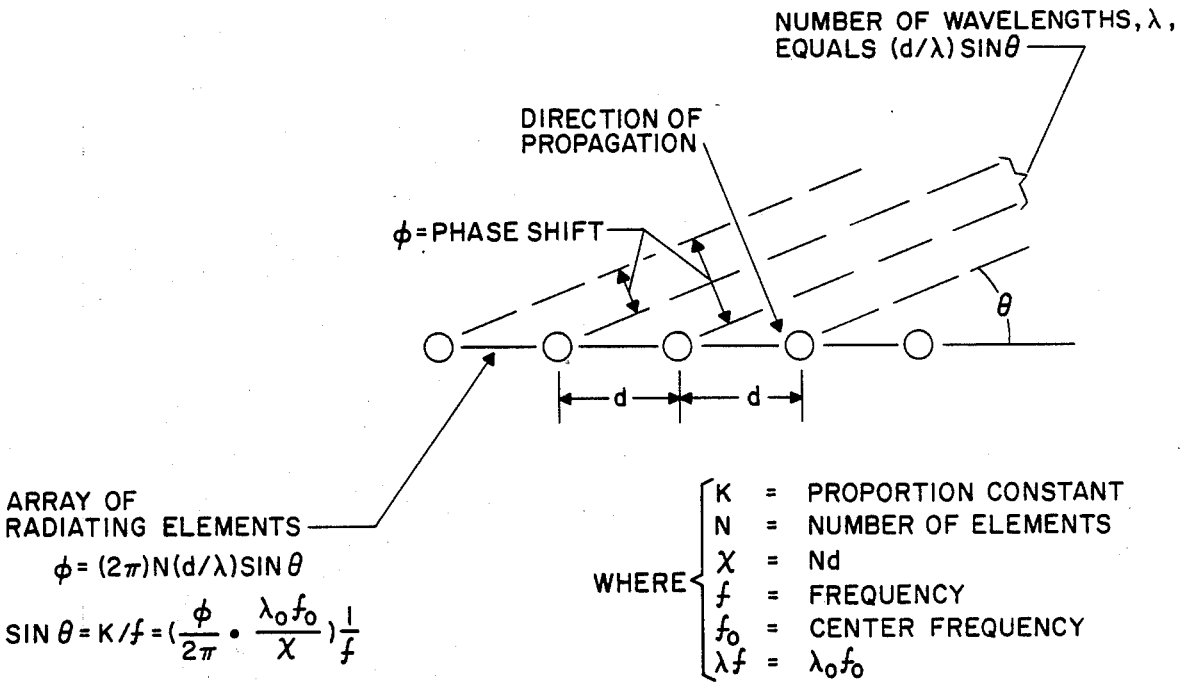
FIG. 1 is a diagramatic view of an array of radiating elements of a phased-array antenna showing differences in phase shift resulting from a wavefront of radiation angled relative to the array.
Figure 2A:
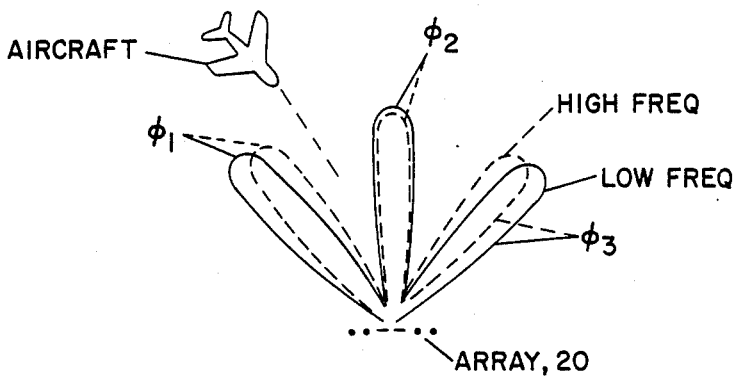
FIG. 2A shows two sets of stepped beam positions, the solid lines designating beams at a lower frequency while the dashed lines indicate beams at a higher frequency.

With reference to FIGS. 1 and 2A, an incident wavefront of radiant energy impinges upon the array of radiating elements from a direction offset from a normal to the array. The spacing between the elements of the array, the wavelength, the angle of the direction of propagation, and the phase shift are all identified by symbols shown in FIG. 1. Since the mathematical description of the requisite phase is the same for both an incoming and an outgoing beam of radiation, the description applies equally well to transmitted and received beams. In particular, it is noted that FIG. 1 provides the mathematical formulation for the requisite phase shift for each element of the array, the requisite phase shift being dependent on the number of elements between which the phase shift is measured, the frequency of the radiation, and on the sine of the angle of propagation relative to a normal to the array.

A shift in frequency or wavelength, a lower frequency being associated with a longer wavelength, results in a shift in beam position as depicted in FIG. 2A. This is in accord with the formula presented in FIG. 1 which shows that the required phase shift varies with the wavelength. Thus, a shift in frequency without a corresponding change in the command to the phase shifters (to be described subsequently) results in a shifting of the beam position for all beams other than the beam pointing straight ahead of the array.

The mathematical relationships presented in FIG. 1 show the effect of beam pointing angle as a function of radiation frequency in terms of center, or midband, values of wavelength and frequency. The mathematical relationships show that the sine of the beam pointing angle varies inversely with the radiation frequency. As depicted in FIG. 2A, a decrease in radiation frequency from the center frequency offsets the beam away from the center beam position, while an increase in frequency offsets the beam towards the center position. This shift is observed for a fixed value of phase shift. A different value of the phase angle produces each of the three beam positions of FIG. 2A.

FIG. 2A also demonstrates the scanning of a beam for an MLS, the scanned beam being received by an incoming aircraft flying towards the array. While only a few beam positions are shown in FIG. 2A, it is to be understood that many steps of beam scanning are employed, the steps being sufficiently close together such that the incremental changes in direction are less than a beamwidth so that a receiver within the aircraft responds as though there were a continuously moving beam. In FIG. 2A, the set of phase-shift commands for each beam direction is indicated by a subscript. Thus, it is seen that, at each beam position, both the beam at the lower frequency and the beam at the higher frequency have the same phase-shift command. However, the resulting beam positions are offset from each other due to a shift in the wavelength and frequency, as noted above. As a practical matter, in the design of the preferred embodiment of the invention, the design frequency is set at the highest frequency of interest, with all of the other frequencies which are to be accommodated being at lower frequencies that the design frequency. By setting the design frequency at the highest frequency of interest, there are more values of stored phase shift data which permit a reduction in the coarseness of the steps in direction of the stepwise scanning at the frequencies lower than the design frequency.

Figure 2B:
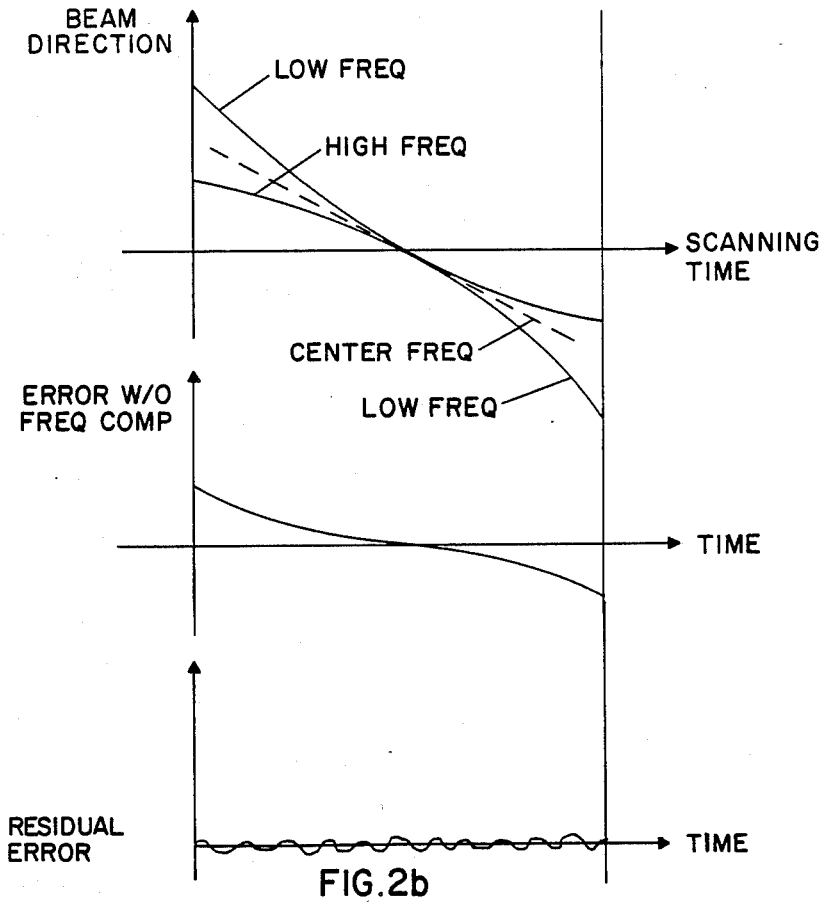
FIG. 2B shows beam angle, relative to a normal to an array of FIGS. 1 and 2A, as a function of scanning time, FIG. 2B also showing beam pointing error in the absence of the frequency compensation of the invention, and a negligible residual error resulting from the frequency compensation of the invention.

In FIG. 2B, three graphs are presented in time registration with each other to show beam direction and error as a function of scanning time, as a beam of FIG. 2A is scanned about the antenna array of FIG. 2A. The upper graph depicts a variation in beam direction as a function of frequency in the absence of the frequency compensation of the invention. A linear scan at the center radiation frequency as a function of scanning time, is indicated by a dashed line. A beam at a higer radiation frequency would tend to deflect with a greater angle than is desired and a beam at higher radiation frequency would deflect at a lesser angle than is desired. The deflections of the higher and lower frequency beams are indicated by solid lines, and result in a nonlinear error as shown in the second graph.

In accordance with a feature of the invention, the effect of the frequency shift on beam position is compensated by commanding a different value of phase shift as a function of scanning time, and dependent on a selected value of radiation frequency. Thereby, either of the solid lines of the first graph, corresponding to either the low frequency or the high frequency situation, is made to coincide with the dashed line to produce a linear relationship between beam direction and scanning time. As a result of this compensation for different values of radiation frequency, the beam pointing error is reduced to essentially an insignificant residual error depicted in the third graph of FIG. 2B. The construction of the system of the invention to provide for the foregoing frequency compensation will now be described with reference to FIGS. 3–6.

Figure 3:
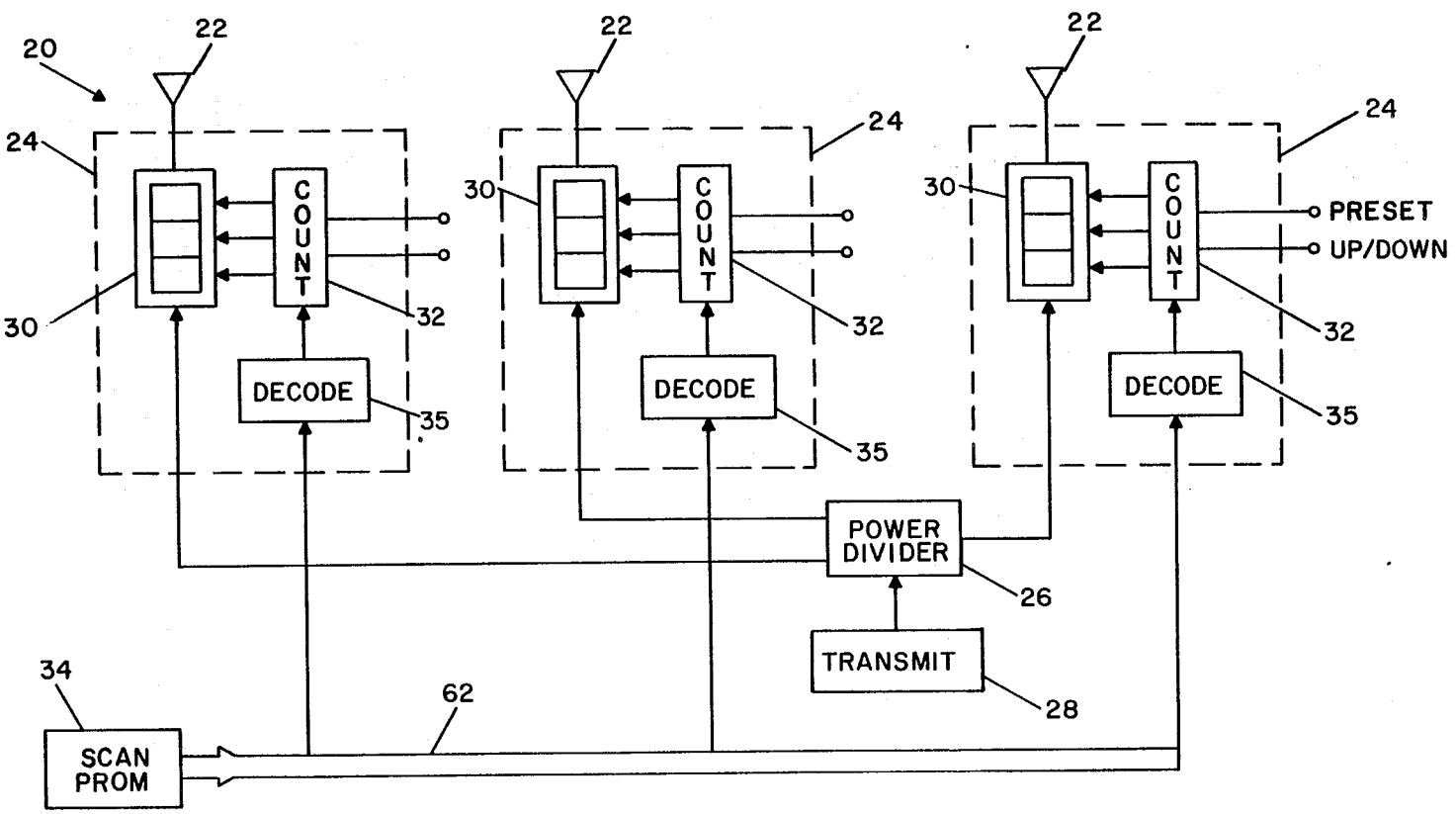
FIG. 3 is a block diagram of phase shift and transmitter circuitry for use with the array of FIG. 1.

With reference also to FIG. 3, there is shown an antenna array 20 having radiating elements 22 corresponding to the array of the elements of FIGS. 1 and 2A. The radiating elements 22 are coupled by phasors 24 and a power divider 26 to a transmitter 28. The transmitter 28 provides electromagnetic power which is divided by the divider 26 among the respective elements 22. The electromagnetic power flows through the phasors 24 which impart the requisite phase shift so that the power radiates from the respective elements 22 with the requisite phase shifts to produce one of the beams shown in FIGS. 2A. Each of the phasors 24 in the preferred embodiment of the invention is constructed with a digitally operated phase shifter 30 and a counter 32 which provides a multidigit signal to activate the respective sections of the phase-shifter 30. A scan PROM 34 (programmable read-only memory) provides signals to each of the counters 32 which increment their respective counts to the required values of phase-shift command. Each of the phasors 24 includes a decoder 35 connected between the scan PROM 34 and the counter 32 for decoding a phasor identification signal transmitted by the PROM 34, thereby insuring that the increment command signals of the PROM 34 are properly identified and applied to the respective ones of the phasors 24.

While each of the phasors 24 employ a digital phase-shifter 30 operated by a counter 32, it is to be understood that other circuitry can be utilized for directing the command to the phase shifter 30. For example, in lieu of the counter 32 and the PROM 34, an alternative form of memory could be utilized for applying directly a multi-digit signal to the phase-shifters 30. However, due to the fact that the antenna system employing the invention generates only a scanning beam for an MLS, it has been found useful to employ the counter 32 with the PROM 34 storing sets of commands for incrementing the respective counts of the counters 32 to the required phase-shifts.

Figure 4:
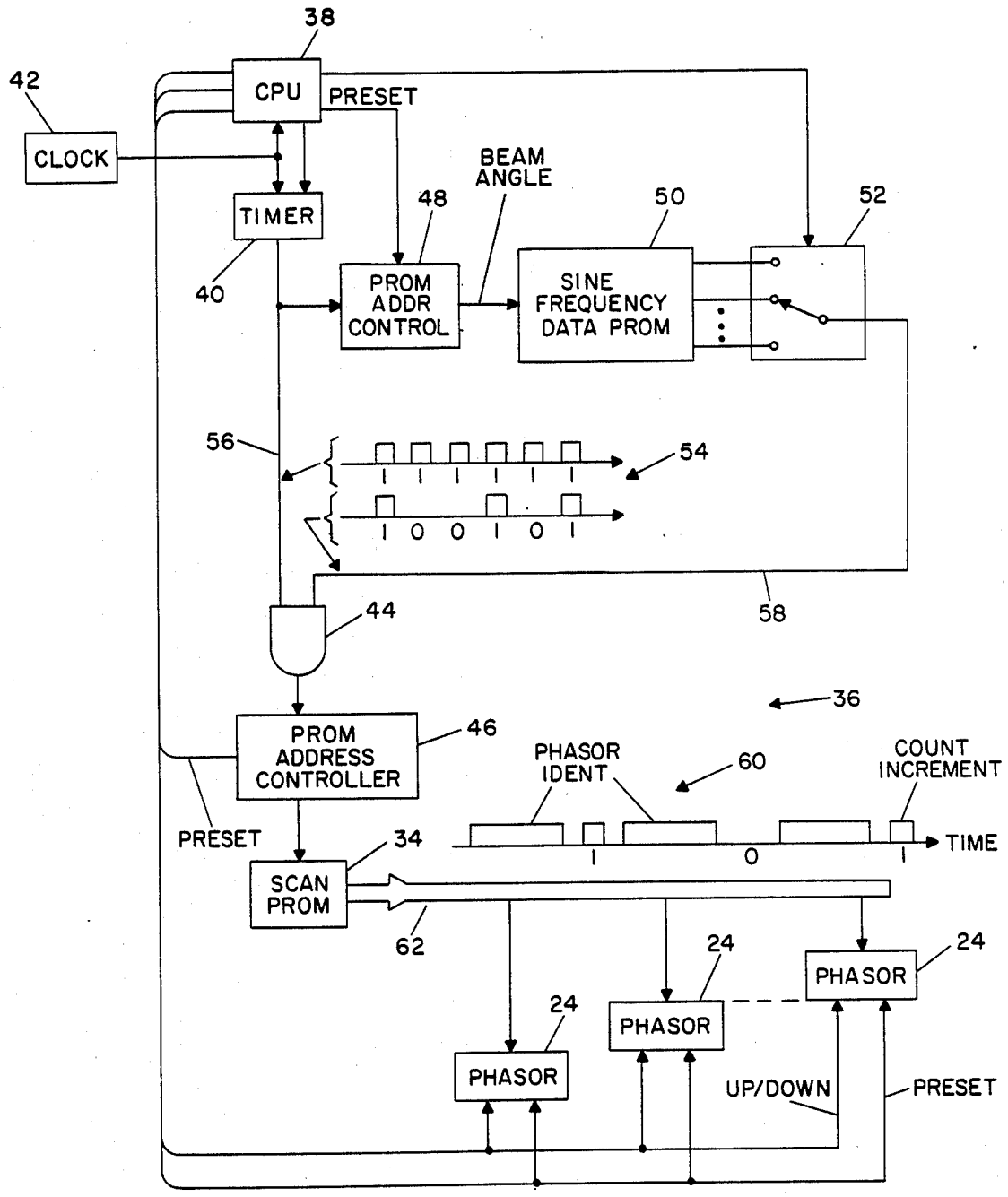
FIG. 4 is a block diagram of circuitry of the invention for applying command signals to the phase shifters of FIG. 3 for stepping the beam direction in accordance with the invention.

With reference also to FIG. 4, a beam scanning unit 36 comprises the phasors 24 and the scan PROM 34 previously seen in FIG. 3. The unit 36 includes a CPU 38 (central processing unit) and a timer 40 which are driven by a clock 42. Clock pulses from the timer 40 are passed by an AND gate 44 to an address controller 46. The address controller 46 includes a counter (not shown), and provides an address to the PROM 34, the address being incremented by the counter of the controller 46 in response to the reception of clock pulses from the gate 44. The beam scanning unit 36 further comprises an address controller 48, a PROM 50 storing data with respect to frequency and the sine of the beam pointing angle, and a switch 52 which selects an output terminal of the PROM 50 in response to a control signal from the CPU 38.

A graph 54 shows two sets of digital signals in temporal registration with each other, the upper set being coupled by the line 56 from the timer 40 to the gate 44 while the signals of the lower set are coupled by the line 58 from the switch 52 to the gate 44. A graph 60 describes the digital signals outputted on a bus 62 by the PROM 34, the signals being applied by the bus 62 to respective ones of the phasors 24.

In operation, the CPU 38 provides signals to the timer 40, the phasors 24, the controller 48 and the switch 52 to provide the desired scanning of a beam from the array 20. The controller 48 includes a counter (not shown) which increments in response to pulses from the timer 40, the counter providing a sequence of addresses to the PROM 50. The memory of the PROM 50 is divided in sections, one section corresponding to the central frequency of each band of receiver channels to be utilized in the MLS for guiding the aircraft of FIG. 2A. For example, in the usual MLS wherein there are 200 separate receiver channels, it has been found adequate to divide the spectral space into 24 separate bands for transmission by the antenna array 20 of FIGS. 2A and 3. Each section of the memory of the PROM 50 is set for the center frequency of one of the foregoing frequency bands. All of the sections of the PROM 50 are simultaneously addressed by the controller 48, the address commanding a specific beam angle for directing the beam of FIG. 2A. The individual sections of the PROM 50 have corresponding output terminals of which one is selected by the switch 52.

Depending upon whether a wide scan or a narrow scan is desired, the CPU 38 presets the counter of the controller 48 to a desired beam angle after which the addresses provided by the controller 48 are incremented by the timer pulses for stepping the beam of FIG. 2A to provide for the scanning of the beam. The data stored in the PROM 50 is of relatively simple form, the data being simply a set of signals designating the increment or non-increment of the counter of the controller 46. The resulting clock pulses exiting from the PROM 50 via the switch 52 are of the same form as the pulses of the timer 40, the two sets of pulses differing only in respect to the presence and absence of certain pulses; the two sets of pulses are coupled via the lines 58 and 56 to the AND gate 44.

The scan PROM 34 stores data with respect to the phase-shift commands for operation of the phasors 24. Since the phasors 24 have been constructed with counters 32, the phase-shift commands provided on bus 62 have the format of a sequence of digital words each of which comprises a field of digits which identify a phasor, followed by a pulse which increments the count of an individual one of the counters 32.

With respect to the construction of the phasors 24, it is noted that the phase-shifters 30 comprise sections of well-known diode phase-shifters of microwave energy. Each section of the phase-shifter 30 includes well-known transmission lines, such as waveguides, having a length equal to an integral number of quarter wavelengths. One segment provides phase-shift in increments of 180°, a second section in increments of 90°, and a third section in increments of 45°. While only three sections shown in the diagram of FIG. 3, it is to be understood that a fourth section having increments of 22.5° is advantageously employed and that, if desired, a still further section for yet finer control of the beam may be utilized. In the case of four sections, the counters 32 count modulo-16. The counters 32 include a preset terminal and an up/down terminal for receiving signals from the CPU 38 to designate a starting count and increments therefrom. Thus, by receipt of a specified number of increment pulses along bus 62, a counter 32 can be driven to any desired output count. Each output line of the counter 32 carries one digit of the count. Each of these lines is coupled to a corresponding one of the sections of the phase-shifter 30 for driving that section. Each output line of the counter 32 provides a logic 1 or a logic 0 depending on the value of the output count. The logic 1 signals activate the corresponding sections of the phase-shifter 30 to which the output signals of the counter 32 are applied. Thereby, the microwave signals receive a phase-shift equal to the sum of the phase-shifts introduced by the individual sections of the phase-shifter 30.

As a useful feature in the implementation of the invention, it is noted that the steps in the scanning direction are sufficiently small such that for any one step the phase shift imparted by any one of the phase shifters 30 may remain unchanged, or may be changed by the smallest phase increment, plus or minus 22.5° in the case of a four-element phase shifter. But such change is never greater than the foregoing smallest phase instrument. Accordingly, the count of a counter 32 of a phasor 24 is never altered by more than a count of one for each stepwise increment in beam position during a scanning of the beam. As a result, the scan PROM 34 sends simply a logic 1 or logic 0 (in addition to the phasor identity) and the CPU 38 sends an up/down signal to a phasor 24 at each step of a scan. The CPU 38 also sends a reset signal to the counter 32 in each phasor 24 for initializing the value of the count at a convenient point in the scanning process. For example, a reset to zero may be employed when the beam passes by the center position, this being zero degrees beam angle, in each sweep of the scan.

In accordance with the invention, the average repetition frequency of pulses on line 58 is equal to one-half of the repetition frequency of the pulses on line 56 at the design frequency of the beam scanning unit 36. For lower values of frequency, pulses may be added to, or deleted from the line 58. The pulses on line 58 serve to gate the pulses on the line 56 through the gate 44, the absence of a pulse on line 58 serving to blank the appearance of a pulse on line 56. Thereby, the number of clock pulses on line 56 from the timer 40 which are applied to the controller 46 depends on the presence of a pulse on line 58. By way of comparison with a single frequency system, the PROM 50 along with the controller 48 and the switch 52 would be deleted, and pulses from the timer 40 would be applied at one-half the present rate directly to the controller 46. It is the presence of the PROM 50 with the controller 48 and the switch 52 which apply the gating pulses via the gate 44 that convert a single frequency system to a multiplefrequency beam-scanning unit 36 of the invention.

The counter in the controller 46 is preset by a signal from the CPU 38 and, thereafter, counts clock pulses supplied by the gate 44. Depending upon whether a wide scan or a narrow scan is desired, the CPU 38 presets the counter of the controller 46 to a desired count for addressing the PROM 34 the count providing the desired beam angle at the start of a scan. Thereafter, the count of the controller 46 is incremented by the clock pulses supplied by the timer 40 via the gate 44 for stepping the beam of FIG. 2A to provide for the scanning of the beam. The CPU 38 also applies an enable signal to the counter of the controller 48 during each scan interval. A scan interval terminates upon termination of the enable signal, at which point further addressing of the PROM 50 and further flow of gating pulses on line 58 are terminated. By virtue of the presetting of the counter of the controller 46 to the beam starting position in a scan, and by terminating further incrementing in the addressing by the controller 46 at the final beam position in a scan, the PROM 34 is activated to provide the phase command signals for the desired range of scan.

Figure 5:
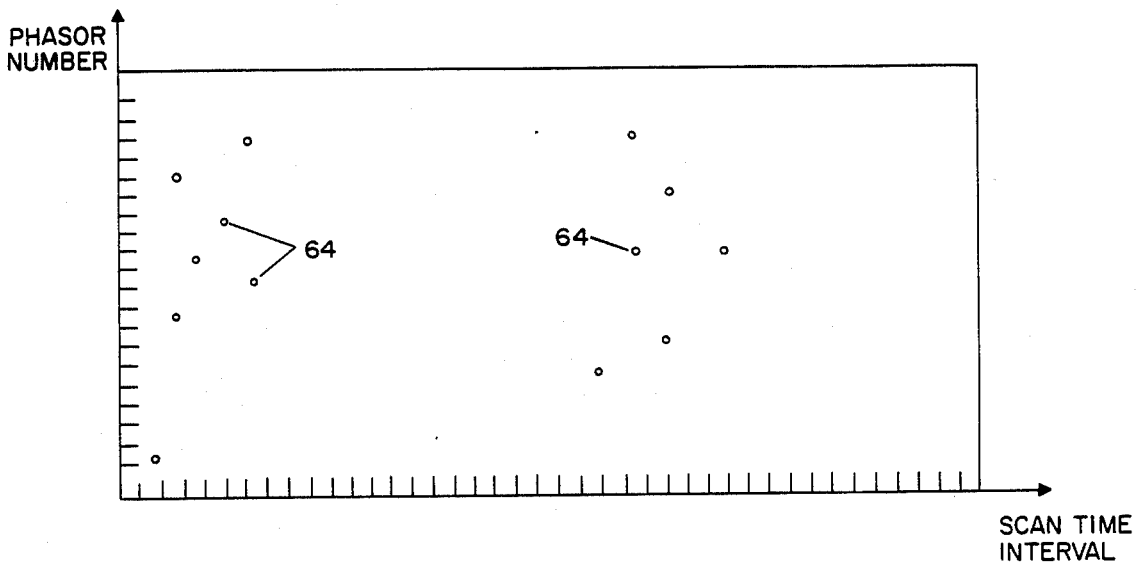
FIG. 5 is a diagrammatic presentation of the contents of a programmable read-only memory of FIG. 4 for commanding an increment in a phase angle of individual ones of phasors of FIGS. 3 and 4.
Figure 6:
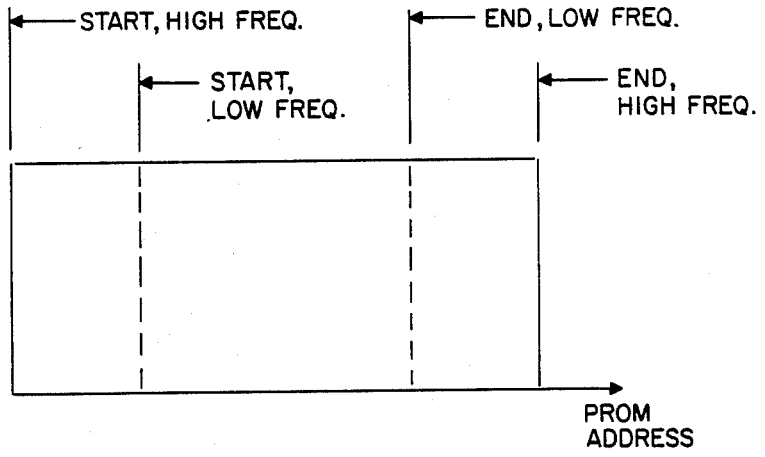
FIG. 6 is a further diagrammatic presentation of the programmable read-only emory of FIG. 5 showing the portion of the memory employed for scanning a beam at different frequencies of radiation.

The operation of the scan PROM 34 under a control of the controller 46 may be further understood with reference to FIGS. 5 and 6. In FIG. 5, the horizontal axis represents increments of time during an interval of scan, each increment of time corresponding to an individual address of the PROM 34. The vertical axis represents identification numbers of the phasors 24. In order to accomplish a full scan at the highest radiation frequency, the entire contents of the PROM 34 is outputted to the phasors 24. With each address from the controller 46, the PROM 34 advances to the next location on the horizontal axis of FIG. 5 to output incrementing pulses 64 shown stored at various locations in FIG. 5.

FIG. 6 is a simplified representation of the graph of FIG. 5 with the PROM address being presented on the horizontal axis. For a full scan at the highest radiation frequency, the controllers 46 and 48 are both preset by the CPU 38 to the address shown at the left side of FIG. 6. Scanning continues until the address at the right side of FIG. 6 is reached. For a full scan at the lowest radiation frequency, the range of addresses is reduced as indicated in FIG. 6. As shown in FIG. 2A, in the case of the lower radiation frequency, the beam tends to deflect through a greater scan angle than is the case for the higher radiation frequency even though the phase angle is the same. Accordingly, the full scan at any frequency is to be attained by using more or less of the stored phase increment commands of FIG. 5 in accordance with the selected radiation frequency. By way of example, by use of approximately 20,000 time increments and addresses on the horizontal axis of FIG. 5, with each time increment being 50 microseconds duration, a complete scan can be executed in one second. For a scan of approximately 40 degrees to either side of center, this being a total scan sector of 80 degrees, the foregoing 20,000 addresses provides for very small increments in beam angle, namely 250 addresses per degree of beam angle. Such small increments in beam angle permit the scanning unit 36 to operate without requiring an increment greater than a count of one to a counter 32 of a phasor 24 during the scanning of the beam.

In the foregoing addressing of the PROM 34, as depicted in FIGS. 5 and 6, irrespectively of whether the complete contents of the PROM 34 are employed, or whether only a portion of the contents of the PROM 34 are employed, the total elapsed time of a single scan is the same. At lower frequencies, wherein less storage regions of the PROM 34 are addressed, additional intervals of time are made up by logic zeros appearing in the pulse train on line 58 as depicted in the graph 54. More logic zeros appear on line 58 for the lower frequencies than at the higher frequencies. This accounts for the increased number of addresses appearing in a single scan for the higher frequency radiation than the lower frequency radiation.

Thereby, the beam-steering unit 36 compensates for changes in frequency of the transmitted radiation by altering the commanded angle to the PROM 34 which, in turn, makes a corresponding change in the commanded phase shift by the phase shifters 30. The phasors 24 then institute a phase shift which closely approximates the amount of phase shift actually required to steer the beam to the desired angle at the new frequency of the radiation. While the total number of steps appearing in the incrementally stepped scan may differ as a function of frequency, there are a sufficient number of steps to provide increments in direction which are smaller than a beamwidth so as to provide the appearance of a smoothly scanned beam. In accordance with the invention, the foregoing features have been attained by use of only one PROM 34 storing phase shift commands for the single frequency case. The only other stored data required is that of the PROM 50, which data relates to the addressing of the PROM 34 to accomplish the skipping (or addition) of steps to the scan.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A multiple frequency antenna system for operation at a selected frequency within a preselected frequency band defined by a first frequency and a second frequency, said system comprising:

(a) a phased array antenna;

(b) a set of phase shifters coupled to elements of said antenna for imparting phase shift to radiant energy of said elements;

(c) memory means coupled to said phase shifters for commanding phase shift to respective ones of said phase shifters to scan a beam of the radiant energy at the first frequency to a commanded angle relative to said antenna;

(d) address means for addressing said memory means with said commanded angle to provide said phase shift; and (e) altering means coupled to said address means for altering said address in accordance with a shift in frequency of said radiant energy from the first frequency to the selected frequency, the amount of said altering substantially compensating for said frequency shift to provide the required phase shift for the desired beam angle for radiation at the selected frequency.

2. A system according to claim 1 further comprising a central processing unit (CPU) coupled to said address means to provide of sequence of addresses for a stepwise scan of said beam of radiation.

3. A system according to claim 2 further comprising timing means for provding a sequence of clock pulses, and wherein said address means is implemented in response to receipt of said clock pulses, said altering means including a means for storing sequences of clock pulses corresponding to the difference between the selected frequency and the first frequency, a train of clock pulses of said storing means being coupled with a train of clock pulses from said timing means to provide a gating of said clock pulses of said timing means for altering the amount of incrementing of said address means.

4. A system according to claim 3 wherein said altering means includes gating means coupled between said timing means and said address means to provide said gating of said clock pulses of said timing means.

5. A system according to claim 4 wherein said CPU is coupled to said phase shifters and to said address means for pre-setting said phase shifters and pre-setting said address means for scanning a beam of radiant energy at the first frequency.

6. A system according to claim 4 wherein said sequences of clock pulses stored within said strong means of said altering means comprises a set of clock pulses spaced apart with differing temporal spacings, the format of spacing of the clock pulses for a one selected frequency of radiant energy within the preselected frequency band differing from the format of the clock pulses for a second selected frequency of the radiant energy within the preselected frequency band whereby the average pulse repetition frequency of the stored sequence of clock pulses at said one selected frequency of the radiant energy differs from the average pulse repetition frequency of the stored sequence of clock pulses at said second selected frequency of the radiant energy.

7. A system according to claim 6 wherein the changes in direction of said beam of radiation relative to said antenna occurring with each step of said step-wise scan is less than a beamwidth to approximate a continuously scanned beam at a plurality of differing frequencies within the preselected frequency band of said radiant energy.

8. A method of step scanning a phased array antenna for operating at a selected frequency within a preselected frequency band defined by an first frequency and a second frequency, said method comprising the steps of:

(a) storing a set of phased shift commands as a function of beam angle for each of said phase shifters at the first frequency of radiation;

(b) sequentially addressing said storing means to provide for a scanning of a beam of radiation at said first frequency of said antenna; and (c) altering said addressing in a sequence of addresses for said scanning, said altering being done as a function of the difference between the first frequency and the selected frequency of the radiant energy to provide for compensation in the relationship of commanded phase shift versus the seleced frequency as a function of a beam angle.

9. A method according to claim 8 wherein said addressing is accomplished by incrementing a count of clock pulses, and wherein said altering is accomplished by gating out certain ones of said clock pulses to provide an average repetition frequency of counted clock pulses which differs as a function of the difference between the first frequency and the selected frequency of radiant energy of said antenna.

10. A method according to claim 9 wherein said gating is accomplished by storing sequences of clock pules spaced apart by differing amounts of temporal spacing.

11. A method according to claim 10 wherein said gating is further accomplished by varying the temporal spacing of the stored sequences as a function of scan angle to provide a rate of incrementing at frequencies between the first frequency and the second frequency which is equal to a rate of incrementing at said first frequency for beams of radiation directed substantially at a normal to the array.

12. A method according to claim 11 further comprising an implementing of phased shift commands by counting incrementing pulses of a sequence of such pulses in a stored phase shift command, said counting including a coupling of a resulting count to phase shifters connecting with radiating elements of said antenna.

* * * * *